US009705262B2

(12) United States Patent
Allen et al.

(10) Patent No.: US 9,705,262 B2
(45) Date of Patent: Jul. 11, 2017

(54) ELECTRONIC SUBASSEMBLY FOR APPAREL

(71) Applicant: Under Armour, Inc., Baltimore, MD (US)

(72) Inventors: Jeffrey Allen, Baltimore, MD (US); Ella Holmes, Baltimore, MD (US); Jason Berns, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 14/855,944

(22) Filed: Sep. 16, 2015

(65) Prior Publication Data

US 2016/0073700 A1 Mar. 17, 2016

Related U.S. Application Data

(60) Provisional application No. 62/050,965, filed on Sep. 16, 2014.

(51) Int. Cl.
*F21V 21/08* (2006.01)
*H01R 13/717* (2006.01)
*A41D 1/00* (2006.01)

(52) U.S. Cl.
CPC ..... *H01R 13/717* (2013.01); *A41D 1/005* (2013.01)

(58) Field of Classification Search
CPC ..... H01R 13/717; F21V 21/108
USPC ..... 362/103, 108, 105; 439/37, 399, 400, 439/449, 452
See application file for complete search history.

(56) References Cited

U.S. PATENT DOCUMENTS 4,570,206 A * 2/1986 Deutsch ..... A41D 27/085 2/115
4,602,191 A * 7/1986 Davila ..... A41D 27/085 315/312
4,709,307 A * 11/1987 Branom ..... A41D 27/085 362/103
4,774,642 A * 9/1988 Janko ..... A41D 27/085 362/103
5,070,436 A * 12/1991 Alexander ..... A41D 13/01 340/321
5,278,734 A * 1/1994 Ferber ..... A41D 27/085 362/103
5,575,554 A * 11/1996 Guritz ..... A41D 27/085 362/103

(Continued)

*Primary Examiner* — Harshad Patel
(74) *Attorney, Agent, or Firm* — Edell, Shapiro & Finnan, LLC

(57) ABSTRACT

An electronic subassembly includes a base panel including a layer of fabric material, a top panel secured to the base panel so as to form a compartment between the base panel and the top panel, where the top panel includes an exterior surface that is configured to couple the subassembly with an apparel product, and a plurality of electronic components, where a first electronic component is disposed within the compartment and a second electronic component extends from the compartment to a location external to the compartment. A strain relief mechanism can also be provided that maintains a first electrical connection of the first electronic component with a second electrical connection of the second electronic component to reduce strain imparted to the first and second electrical connections when the surface of the apparel product to which the subassembly is secured is subjected to stretching or pulling forces.

17 Claims, 14 Drawing Sheets

(56) References Cited

U.S. PATENT DOCUMENTS 5,690,411 A * 11/1997 Jackman ..... G08B 5/006 362/103
5,836,673 A * 11/1998 Lo ..... A41D 13/01 362/103
5,984,488 A * 11/1999 Tung ..... A41D 13/01 362/108
6,267,482 B1 * 7/2001 Miller ..... A41D 13/01 362/103
6,474,830 B1 * 11/2002 Hansen ..... A44B 1/04 362/103
6,538,567 B2 * 3/2003 Stewart ..... A41D 13/01 340/475
7,077,538 B2 * 7/2006 Wooldridge ..... A41D 13/01 362/103
7,234,831 B1 * 6/2007 Hanley ..... A42B 1/244 2/209.13
8,416,579 B2 * 4/2013 Biesheuvel ..... H01R 4/58 361/777
8,732,866 B2 * 5/2014 Genz ..... F21V 23/04 2/115
2004/0184262 A1 * 9/2004 De Silva ..... A41D 13/01 362/108
2005/0078473 A1 * 4/2005 Zuloff ..... A42B 1/004 362/106
2006/0104052 A1 * 5/2006 Golle ..... A41D 13/01 362/103
2006/0165160 A1 * 7/2006 Winningstad ..... G07C 1/10 375/219
2006/0291193 A1 * 12/2006 Hill ..... A41D 13/01 362/108
2007/0135679 A1 * 6/2007 Hunt ..... A61B 1/00154 600/102
2008/0028497 A1 * 2/2008 Hayes ..... A42B 1/067 2/171
2008/0263750 A1 * 10/2008 Chen ..... A42B 1/245 2/209.13
2011/0122601 A1 * 5/2011 Waters ..... A42B 1/244 362/106

* cited by examiner

ELECTRONIC SUBASSEMBLY FOR APPAREL

CROSS-REFERENCE TO RELATED APPLICATION

This application claims priority to U.S. Provisional Patent Application No. 62/050,965, filed Sep. 16, 2014, entitled "Electronic Subassembly For Apparel," the entire disclosure of which is incorporated herein by reference.

FIELD

The present invention relates to electronic components integrated with apparel.

BACKGROUND

With the continuous advances in electronics technology, electronic devices are becoming integrated with many types of commonly used items. The integration of electronic devices with apparel has recently become of interest. However, apparel manufacturers struggle with the ability to integrate electronic devices within apparel (such as t-shirts, shorts, pants, jerseys or other sports related clothing, etc.) in an easy and reliable manner so as to maintain a reliable electrical connection for such electronic devices when the apparel is worn by a user.

SUMMARY

An electronic subassembly comprises a base panel comprising a layer of fabric material, a top panel comprising an adhesive layer secured to the base panel so as to form a compartment between the base panel and the top panel, the top panel including an exterior surface configured to couple the subassembly with an apparel product, and a plurality of electronic components, where a first electronic component is disposed within the compartment and a second electronic component extends from the compartment to a location external to the compartment.

A strain relief mechanism can also be provided that maintains a first electrical connection of the first electronic component with a second electrical connection of the second electronic component to reduce strain imparted to the first and second electrical connections when the surface of the apparel product to which the subassembly is secured is subjected to stretching or pulling forces.

The above and still further features and advantages of embodiments of the present invention will become apparent upon consideration of the following detailed description thereof, particularly when taken in conjunction with the accompanying drawings wherein like reference numerals in the various figures are utilized to designate like components.

BRIEF DESCRIPTION OF THE DRAWINGS

Like reference numerals have been used to identify like elements throughout this disclosure.

DETAILED DESCRIPTION

As described herein, an electronic subassembly for an apparel product (e.g., a shirt such as a t-shirt or sweatshirt, shorts, pants, a jersey, a jacket or other sports related and/or other types of clothing, etc.) includes a strain relief connector integrated within the subassembly that effectively secures wiring within the subassembly to maintain one or more electrical connections for electronic devices combined with the apparel despite stretching or straining of the fabric material of the apparel during use. A method for integrating the subassembly within apparel is further described herein by assembling components of the assembly that provide a protective barrier for electrical components within the assembly and utilizing simple but effective heat transfer techniques to bond and seal the subassembly with a fabric section of the apparel.

Figure 1:
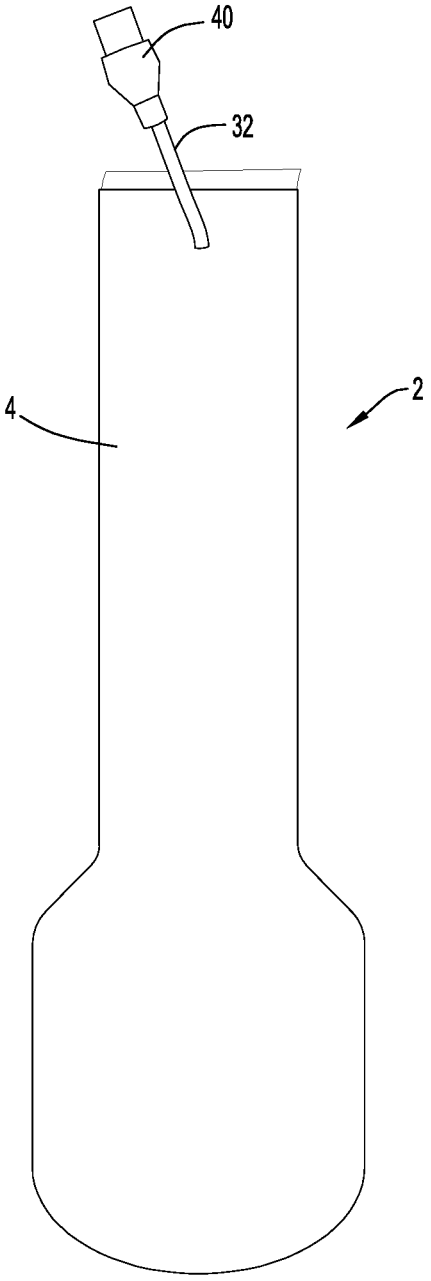
FIG. 1 is a bottom (base panel) view in plan of an example embodiment of an electronic subassembly for apparel.
Figure 2:
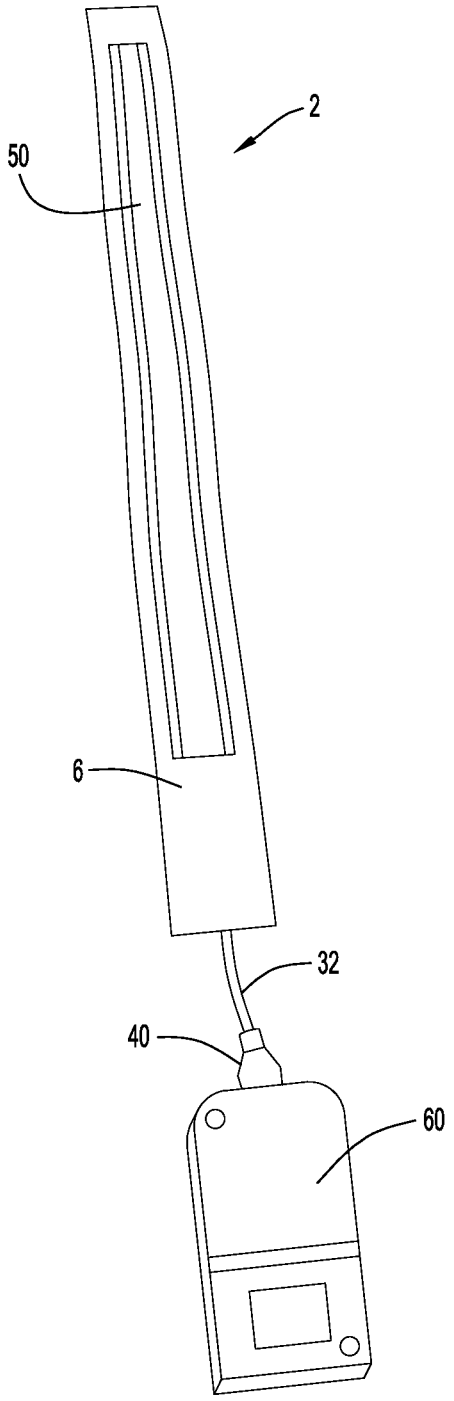
FIG. 2 is a top (top panel) view in plan of the electronic subassembly of FIG. 1.

An example embodiment of an electronic subassembly 2 is depicted in FIGS. 1-4. Referring to FIGS. 1 and 2, the subassembly 2 includes fabric bottom or base panel 4 and an adhesive top panel 6 forming outer surface portions of the subassembly 2, where electronic components as described herein are disposed between a compartment formed between the two panels 4, 6. As further described herein, when the panels 4, 6 are secured to each other around their edges, electronic component(s) disposed within the compartment between the panels are effectively sealed and protected from external elements (e.g., moisture, dust and other foreign matter).

In certain example embodiments, a cut-out section of the top panel 6 forms a window exposing a light panel 50 disposed between the panels 4, 6. The light panel 50 comprises a thin and flexible sheet of material including suitable electronic components and/or electronic circuitry that facilitate illumination of one or more colors of light from the panel 50. The light panel 50 includes a pair of contact pads or conductive strips 52 disposed at or near at least one end of the panel, where the conductive strips 52 provide electrical contacts for electrical wiring coupled with the panel. An example embodiment of a light panel 50 that can be provided as an electronic component within the subassembly 2 is of the type commercially available under the trademark Elastolite® (Oryon Technologies, Texas), which comprises an electroluminescent device that emits light by conversion of electrical energy into light via energized phophors disposed within the panel 50. However, the Elastolite® electronic device is provided by way of example only and the present invention is not limited to this specific type of electronic device. Instead, it is noted that any other type of light source and/or any other one or more types of electronic devices can also be integrated within a subassembly utilizing techniques as described herein.

Figure 3:
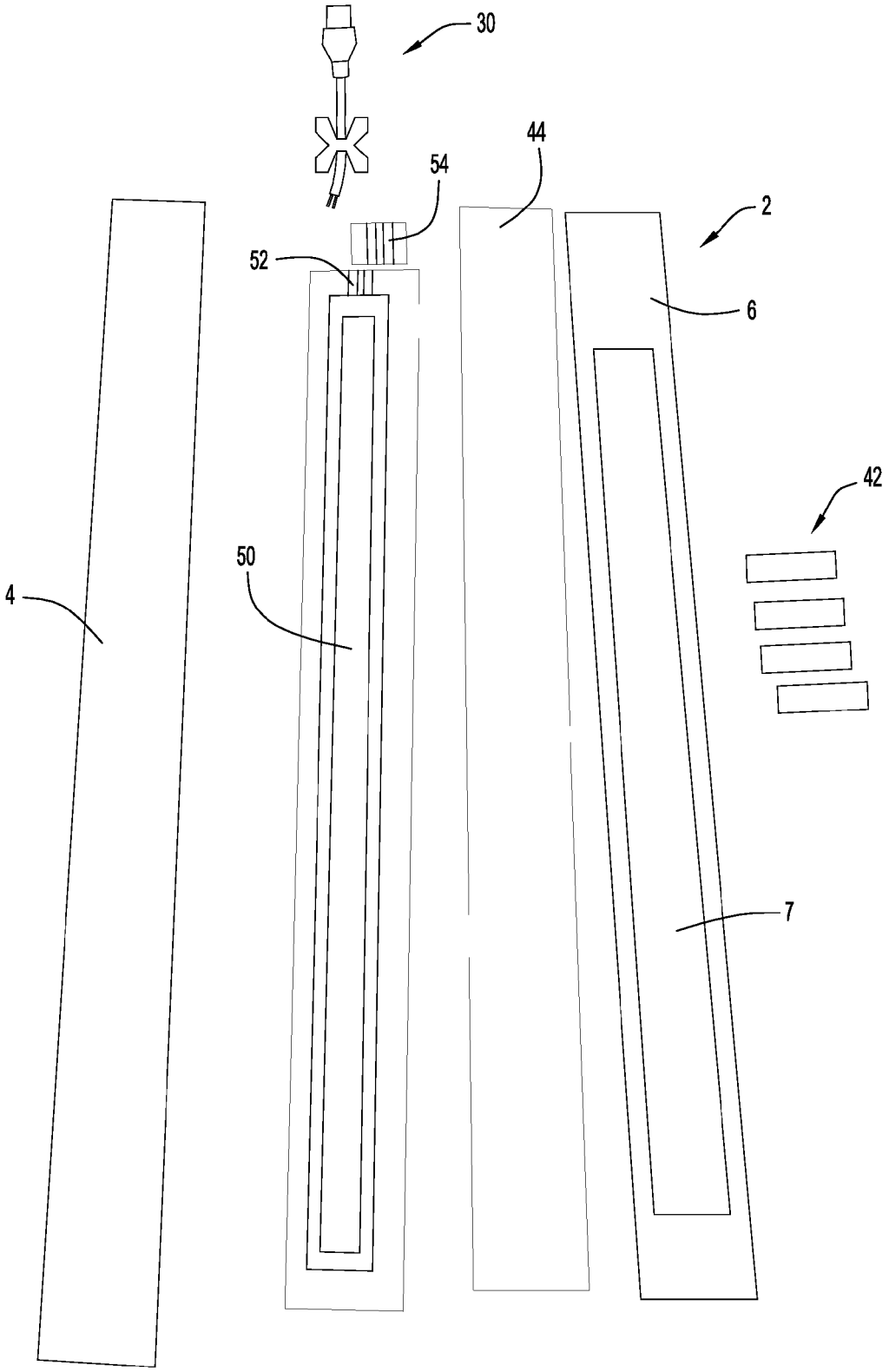
FIG. 3 is a view of individual components utilized to form the electronic subassembly of FIGS. 1 and 2.

An unassembled (exploded) view of the components utilized to form the assembly 2 of FIGS. 1 and 2 is provided in FIG. 3. In addition to the outer panels 4, 6 and light panel 50, other components are also shown and described in further detail herein, including one or more electronic components of an electronic device disposed beneath the panel 4 as described herein. While the outer panels 4, 6 are depicted in FIGS. 1-3 as having generally rectangular configurations, the panels can instead be configured to have any one or more suitable shapes depending upon the particular intended use for the subassembly 2.

The fabric base panel 4 comprises a fabric material layer and an adhesive backing formed on one side of the fabric material layer. In particular, the adhesive backing is formed on an interior side of the base panel 4 such that, upon assembly of the components of FIG. 3, the adhesive backing faces electronic components and the top panel 6 secured to the base panel. The fabric material layer of the base panel 4 can be formed from any one or more suitable types of synthetic yarns, fibers and filaments that further comprise one or more polymers (e.g., monomers and/or co-polymers) including, without limitation, polyurethanes, polyamides (e.g., nylon), polyesters (e.g., polyethylene terephthalate), polyolefins (e.g., polypropylene), and any selected combinations thereof. The adhesive backing can be formed along the entire interior side of the fabric material layer or at any one or more selected portions along the interior side so as to effectively secure components as well as portions of the top panel 6 to the fabric material. The adhesive backing can comprise any one or more suitable adhesive layers that effectively secure the base panel 4 to other components of the assembly 2. In the example embodiment of FIGS. 1-3, the adhesive backing includes a thin layer (about 0.003 mil) of polyurethane seam tape commercially available under the tradename Bemis ST-104 (Bemis Associates Inc., Massachusetts) and a further adhesive polyurethane thin film layer (about 0.003 mil) commercially available under the tradename Bemis 3415. The adhesive backing can further be heat treated, as described herein, to activate the adhesive component(s) of the backing.

The top panel 6 can also be formed of any suitable material suitably configured to secure to the base panel 4 and/or components secured between the panels 4, 6. In the example embodiment of FIGS. 1-3, the top panel 6 with cut-out section or window 7 is formed from an adhesive polyurethane thin film layer (about 0.003 mil) commercially available under the tradename Bemis 3415. A further film layer 44 can also be applied during assembly over the top panel 6 according to the techniques described herein. In the example embodiment, the film layer 44 is a thin (about 0.003 mil) polyurethane seam tape commercially available under the tradename Bemis ST-104.

Other components of the subassembly 2 depicted in FIG. 3 include the light panel 50, which includes electrically conductive contact strips 52 (which are electrically coupled to electrical circuit elements of the light panel) extending at an end of the light panel, adhesive strips 42 for securing components of the subassembly to each other during assembly (as described herein), dual trace electrically conductive (e.g., silver conductive) strips 54 to secure an electrical connection between the light panel 50 and another electrical component located external to the sealed panels 4, 6, and a strain relief connection mechanism 30.

Figure 4:
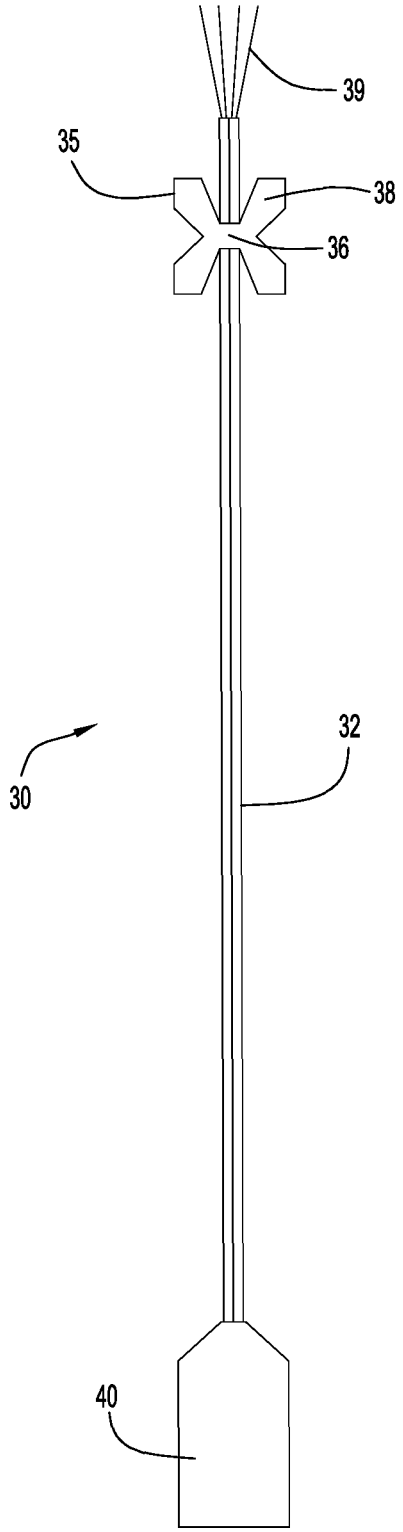
FIG. 4 is a view of an example embodiment of a strain relief connector for use with the subassembly of FIG. 1.
Figure 5:
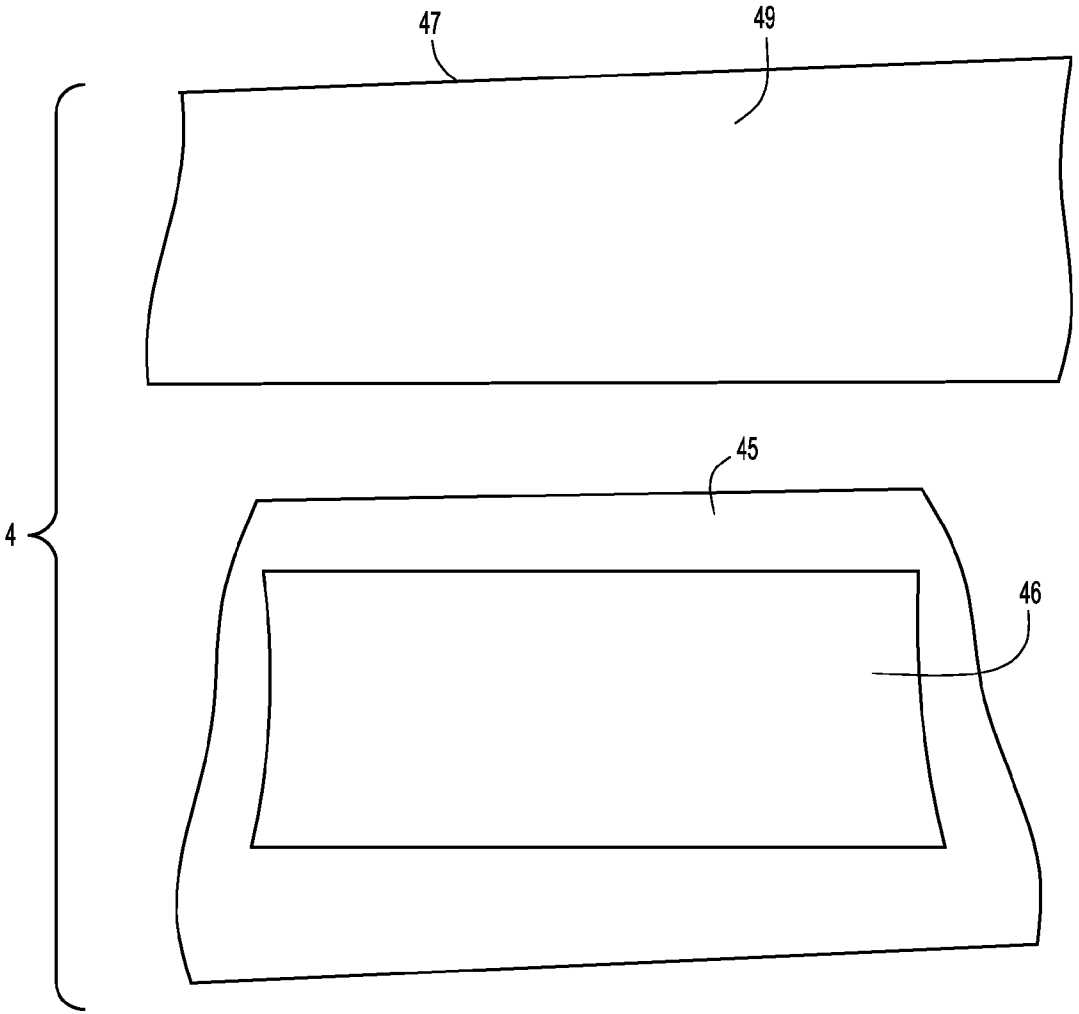
FIGS. 5-11 depict views of a partially assembled electronic subassembly showing how the components of FIG. 3 are combined to form the subassembly of FIG. 1.
Figure 6:
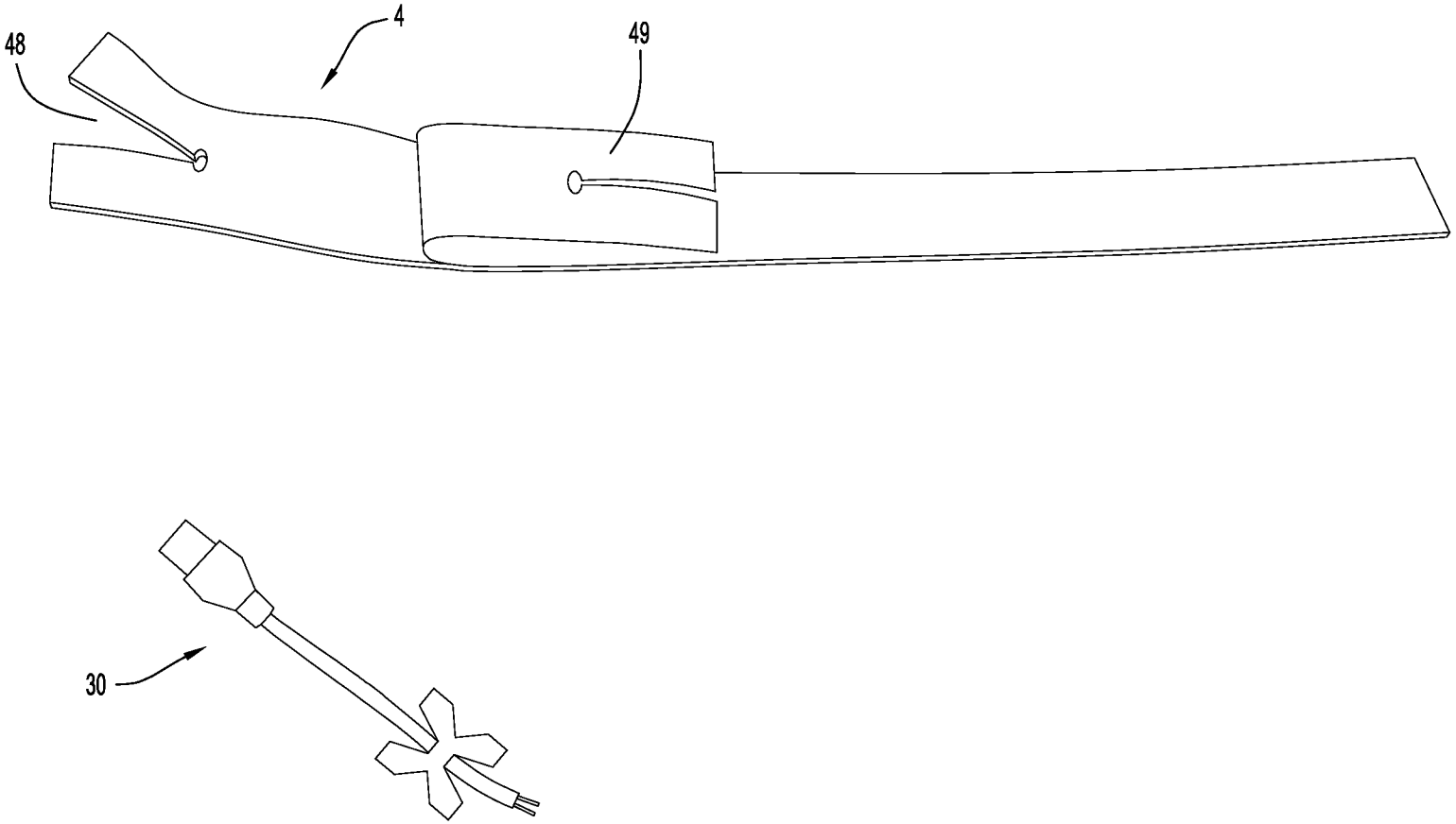

An example embodiment of a strain relief connection mechanism 30 utilized for the subassembly 2 is depicted in FIG. 4. The mechanism 30 comprises a strain relief connector 35 that is secured to wiring 32 for an electrical connector 40. The wiring 32 can comprise any conventional or other type of wiring for electronic components, where the wiring includes an outer, protective insulating sheath that surrounds a plurality of conductive wires 39 (where the wires within the outer sheath may further be individually sheathed in a conventional or any other suitable manner). As described herein, the wiring 32 electrically couples the light panel 50 and/or other electronic components disposed within the subassembly 2 to the electrical connector 40 disposed external to the subassembly. The electrical connector 40 can be of any suitable type and have any suitable configuration to facilitate connection with an electrical power supply and/or one or more other electronic components exterior to the subassembly 2. For example, the electrical connector 40 can include a suitable connector configured to connect with a power supply 60 (see FIGS. 1 and 2), where the power supply 60 includes a battery compartment that receives batteries for powering the light panel 50.

The strain relief connector 35 comprises a thin base plate having a central portion 36 with a plurality of elongated relief arms 38 extending radially outward and in different directions from the central portion 36. In particular, the strain relief connector 35 depicted in FIG. 4 includes four relief arms 38 extending in different directions from the central portion 36 so as to define a general "X" shape for the strain relief connector (e.g., each relief arm is spaced about the central portion at approximately 90° from a neighboring relief arm). In the example embodiment of FIG. 4, each of the relief arms 38 has a similar length and width, where the width along the length of the each arm can be constant or can vary. In an example embodiment in which the width of the relief arms varies, the width of each relief arm 38 can have its shortest width at or near its connection with the central portion 36, where the width of the arm 38 increases slightly as the arm extends away from the central portion 36 to its terminal or free end. Further, the width of each relief arm 38 can decrease and taper at a location of its greatest width (at a location proximate but slightly short of its free end) such that opposing and lengthwise extending edges of the arm 38 converge toward each other at its free end (e.g., to define a pointed edge). Thus, the width of each strain relief arm 38 can vary (e.g., from narrower to wider to narrower or in any other manner) as the arm 38 extends longitudinally or lengthwise from the central portion 36. The strain relief arms can each have the same geometric size and/or configuration. Alternatively, any two or more strain relief arms can have different sizes and/or geometric shapes/configurations. Other shapes or geometric configurations for the strain relief connector can also be utilized to achieve a desired strain relief for electrical connections within the subassembly, such as the other example types of strain relief connectors described herein and depicted in FIGS. 12 and 13.

The strain relief connector 35 can be formed of any suitably resilient and durable material (e.g., leaf spring metal materials and/or other types of flexible metals and/or flexible polymer materials) that facilitates resilient stretching or straining of relief arms 38 of the connector 35 in different directions based upon stretching forces applied to the top and/or bottom panels 4, 6 during use of the assembly 2.

An example embodiment for constructing the subassembly 2 depicted in FIGS. 1-3 is now described with reference to FIGS. 5-11. It is noted, however, that the subassembly can be constructed utilizing any other suitable manufacturing process and/or any other types of materials other than that which are described herein. At FIG. 5, the fabric base panel 4 depicted in FIG. 3 is constructed by applying a Bemis ST-104 polyurethane seam tape layer 46 to a surface of a fabric sheet 45 and heating the tape layer 46 (e.g., utilizing a heating iron or other suitable heating device) to a suitable temperature (e.g., about 132° C. for about 16 seconds) to adhere the tape layer 46 to the surface of the fabric sheet 45. A Bemis 3415 adhesive film layer 47 is then pre-tacked to the seam tape layer 46 and heated to a suitable temperature (e.g., about 132° C. for about 6 seconds) to adhere layer 47 to layer 46, thus forming the fabric base panel 4. It is noted that the film layer 47 is a double sided adhesive film layer, and the outer surface of the film layer 47 (i.e., the surface of film layer 47 that opposes the surface adhered to tape layer 46) includes a peelable paper layer 49 that is removed from the adhesive surface of the film layer 47 prior to adhering this surface to another structure. At FIG. 6, the fabric base panel 4 is cut utilizing any suitable technique (e.g., via a laser cutting technique, mechanical trimming, etc.) to its final desired shape. In addition, a slit 48 is provided in the panel 4 that extends from an end and a selected distance in a lengthwise direction of the panel 4. The slit 48 is formed having a sufficient length so as to receive a portion of the strain relief connection mechanism 30 including strain relief connector 35 and wiring 32 and folding of the end of the panel 4 over such portion in a subsequent assembly step described herein. After cutting the panel 4 to the desired dimensions, the paper layer 49 is then removed from the surface of film layer 47.

Figure 7:
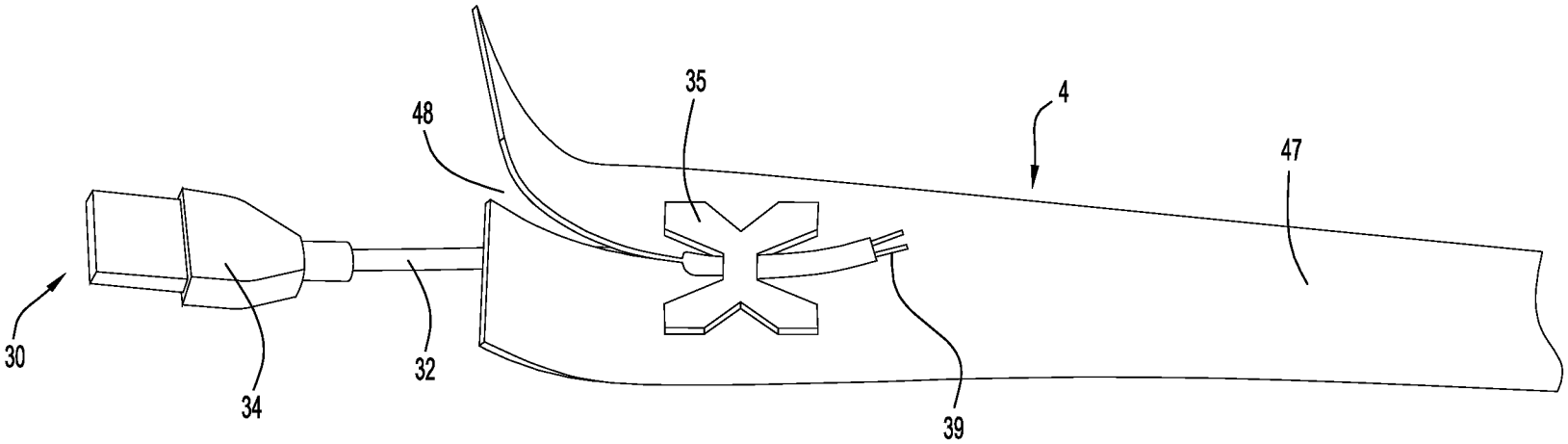
Figure 8:
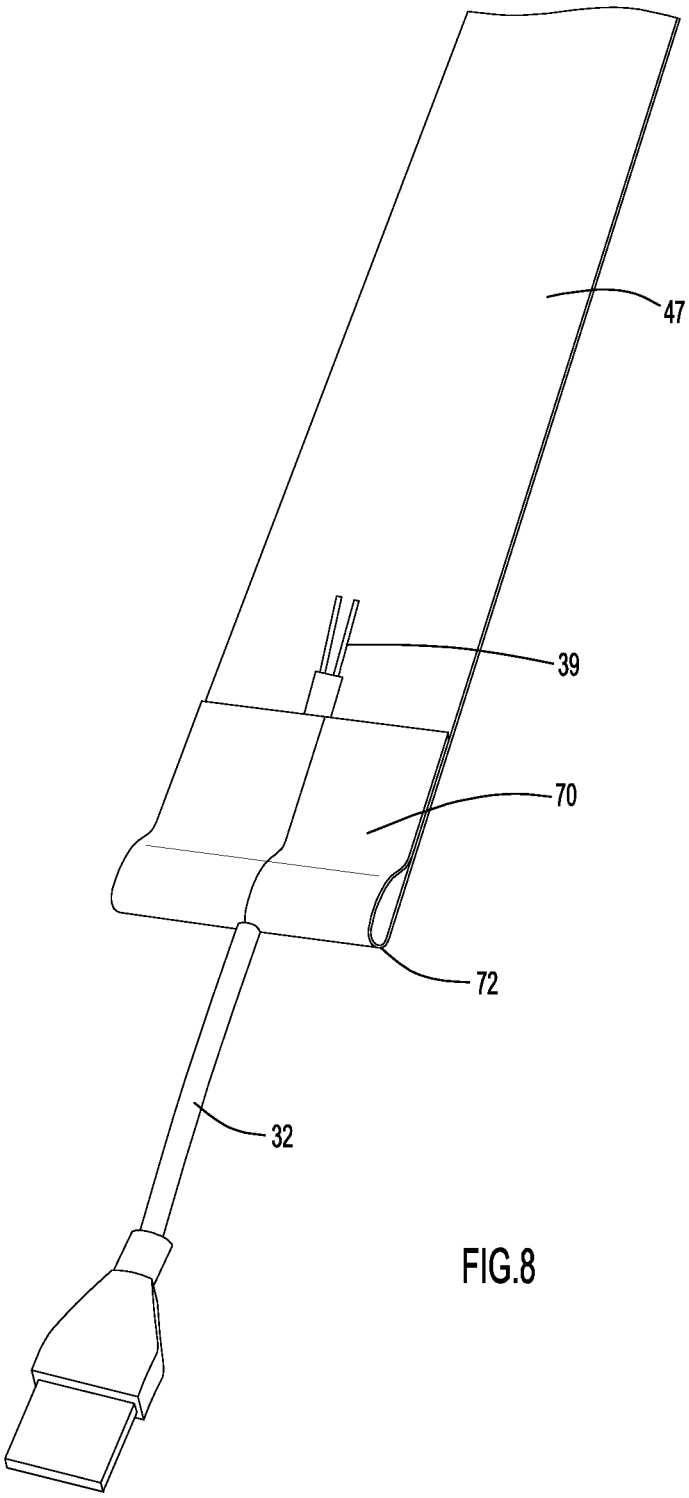

At FIG. 7, the strain relief connection mechanism 30 is placed along the panel slit 48 such that a portion of the wiring 32 including strain relief connector 35 and conductive wires 39 is disposed along and adjacent the exposed adhesive surface of the film layer 47 while another portion of the wiring 32 and the connector 34 are distanced from the panel 4. At FIG. 8, an initial end portion 70 of the panel 4 including the slit 48 is folded over upon itself on the panel side defined by the film layer 47 to cover part of the wiring 32 and also the strain relief connector 35 with the initial end portion 70 while leaving the conductive wires 39 of the wiring 32 exposed. In addition, the wiring 32 and connector 35 are aligned through the slit 48 and in relation to the panel 4 prior to folding such that there is a sufficient distance (e.g., about 0.5 inch) between the connector 35 and the final or folded end 72 of the panel 4 (i.e., the lengthwise end of the panel 4 formed as a result of folding the initial end portion 70 onto the panel on the side defined by the film layer 47) after the folding operation. In other words, after the folding operation, the connector 35 is secured under the end portion 70 without contacting the folded end 72. The exposed conductive wires 39 can be curled in a curved shape so as to reduce their lengthwise dimensions.

Figure 9:
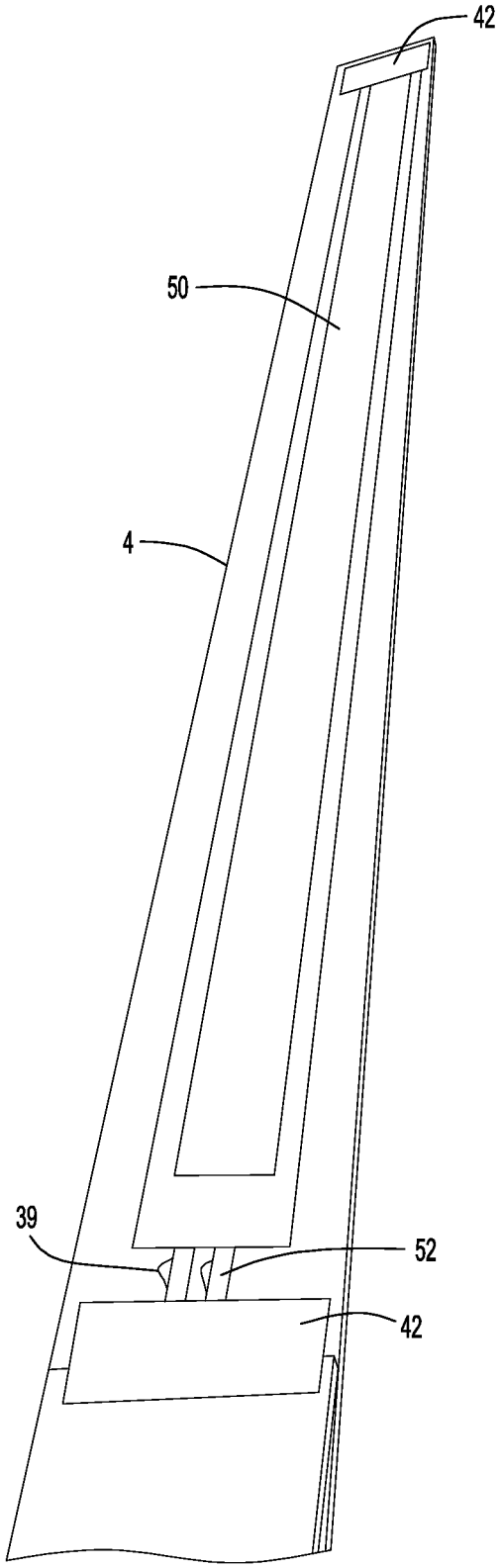

At FIG. 9, the light panel 50 is placed upon the side of the top panel 4 defined by the film layer 47 and oriented such that the conductive contact strips 52 are aligned with and are located below the conductive wires 39 of the wiring 32. An adhesive strip 42 is placed at an end of the light panel 50 that opposes the light panel end including contact strips 52, where the adhesive strip 42 secures the light panel to film layer 47. At the light panel end including the contact strips 52, conductive wires 39 are aligned with to engage corresponding contact strips 52 of the light panel 50. For example, in an embodiment where the wiring 32 includes a pair of conductive wires 39 independently sheathed within the wiring 32, one exposed conductive wire 39 (i.e., sheath is removed to expose the wire) is aligned to engage with a first contact strip 52 while the other exposed conductive wire 39 is aligned to engage with a second contact strip 52 that is electrically isolated from the first contact strip. An adhesive strip 42 is also placed over the sheathed portions of the conductive wires 39 and also a portion of the light panel 50 that supports but is electrically isolated from the contact strips 52 so as to secure the wiring 32 in relation to the light panel 50 at the contact strip end.

Figure 10:
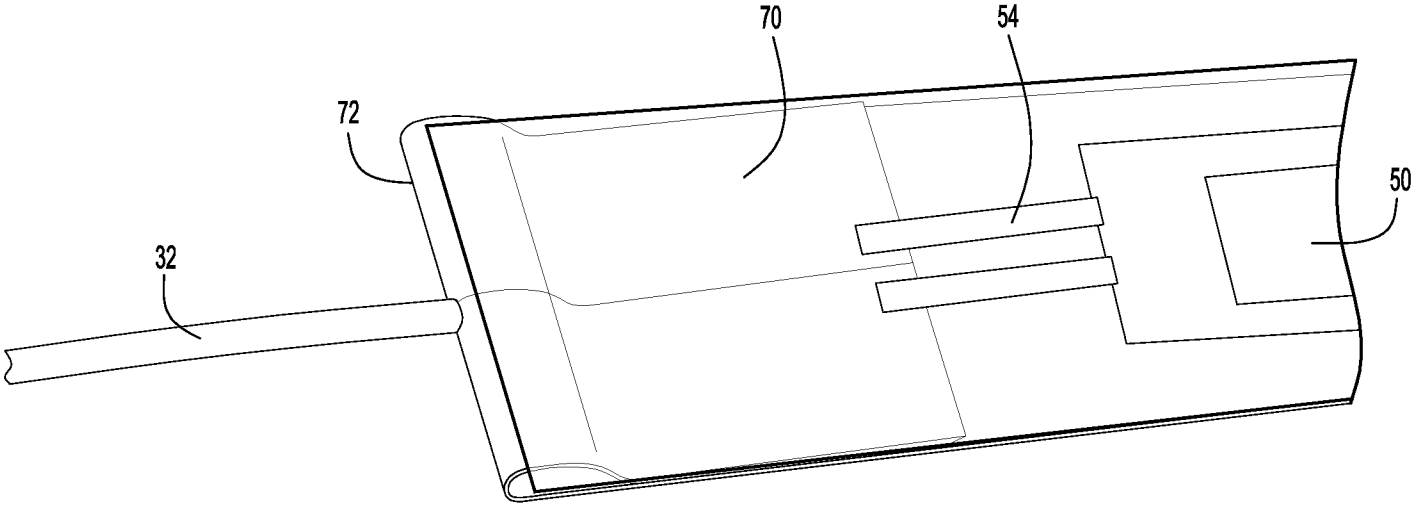

At FIG. 10, the dual trace electrically conductive strips 54 are placed over and pressed onto the conductive wires 39 and contact strips 52 to provide a sealed electrical connection between wiring 32 of the strain relief mechanism 30 and the light panel 50. A further adhesive strip 42 is placed over the dual trace electrically conductive strips 54 to secure the strips 54 in place in relation to the conductive wires and contact strips 52.

A film layer 44 (provided in the form of Bemis ST-104 polyurethane seam tape) is applied over panel 4 at the side defined by film layer 47 and which includes the light panel 50. The film layer 44 is pre-tacked after application until it is translucent. Next, the adhesive top panel 6 is applied to the film layer 44 at FIG. 11. The adhesive top panel 6 is aligned to correspond with bottom panel 4 and such that the window 7 of the panel 6 is aligned with a section of the light panel 50 that includes light elements, thus forming the subassembly 2.

Figure 11:
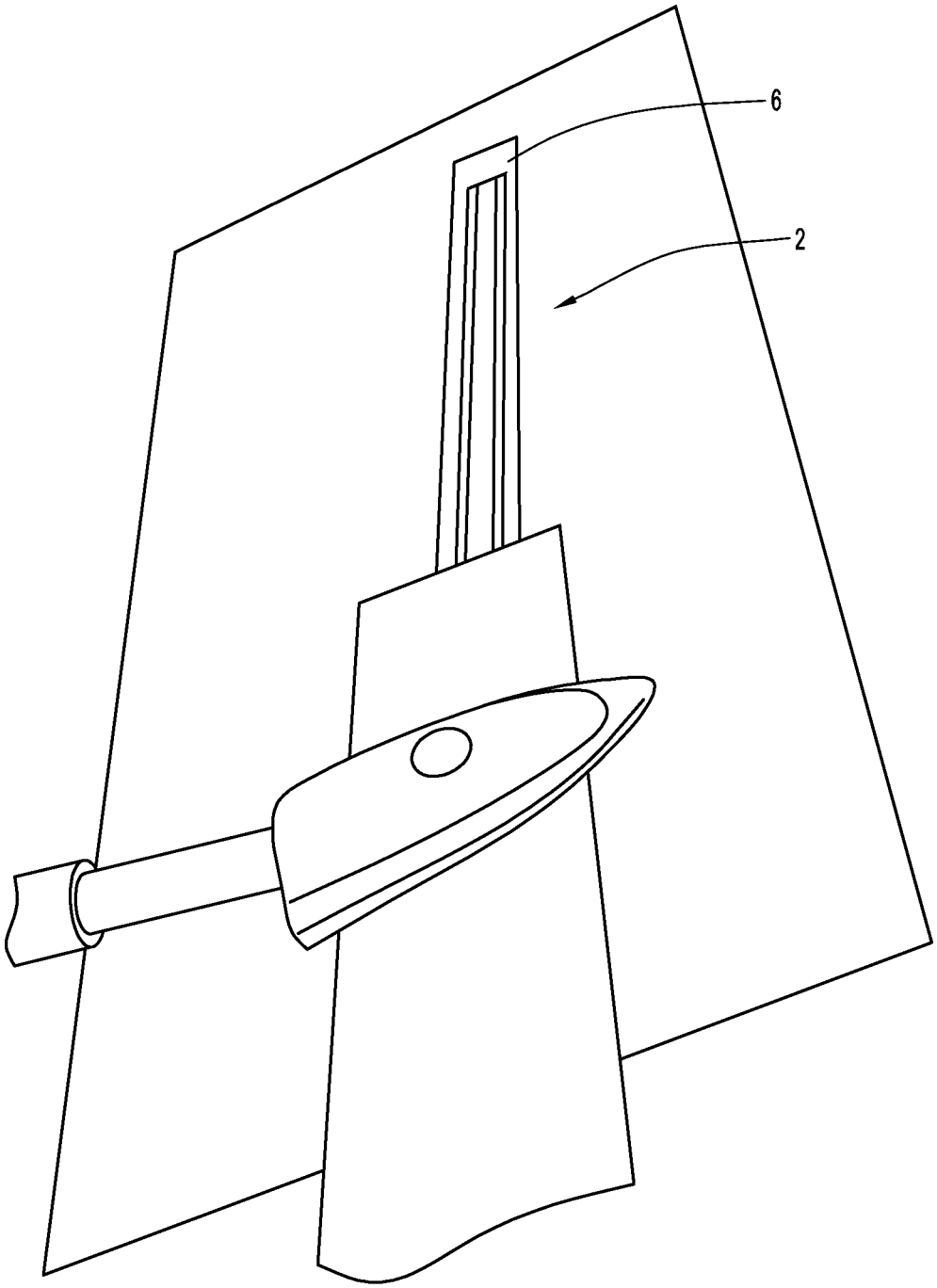

The subassembly 2 of FIG. 11 is heated in any suitable manner so as to adhere the facing surfaces of panels 4, 6 to components disposed between the panels as well as the facing peripheral surface portions of the panels to each other so as to seal the components between the panels. In an example embodiment, the subassembly 2 is placed with either panel up first in a heat press (with Teflon and/or heat conducting foam sheets placed between the panels and the heat press) and heating to a suitable temperature (e.g., 132° C. for 18 seconds), and then turning the assembly over such that the other panel is placed upward and heating again in the heat press. This heating process effectively activates the adhesion components of the film layers 44, 47 to effectively seal the subassembly components together within a compartment defined between panels 4, 6.

The exposed surface of the top panel 6 can further include an adhesive material that is covered by a peelable paper or by any other suitable structure to facilitate securing of the subassembly 2 via the exposed top panel surface to any selected apparel or other textile surface (e.g., the surface of a t-shirt, a sweatshirt or sweat pants, etc.) so as to integrate the light panel for use with the textile product to which the subassembly is secured.

Prior to use, the subassembly 2 can be secured to any textile or other structure to which it is to be integrated, such as apparel. For example, the subassembly 2 can be adhered to an underside portion of apparel (e.g., the underside of a shirt) in a relatively easy manner with the top panel 6 facing the apparel surface to which the subassembly is to be integrated. The peelable paper of the top panel outer or exposed surface can be removed, and the subassembly adhered to the apparel surface (e.g., via a heating process similar to those described in relation to adhering components to each other during subassembly construction). Attachment of the subassembly 2 to apparel can be performed by the manufacturer of the subassembly or, alternatively, by an end supplier. For example, the subassembly 2 can be manufactured by a vendor to an apparel manufacturer, where the apparel manufacturer then installs the subassembly as an integral part of the apparel.

In an example embodiment in which the subassembly 2 is integrated with apparel (e.g., a shirt), a user wearing the apparel can control the electronic components of the subassembly, e.g., by engaging a power switch or other activation feature disposed on or near the electrical connector 34 and/or power supply 60. Electrical power is provided from the power supply 60 disposed external the subassembly 2 to one or more electronic components within the subassembly, such as the light panel 50 described in the previous embodiment. For example, the light panel 50, when activated, emits light via lighting elements of the light panel, where the light is further emitted through the window 7 of the top panel 6 and toward the surface of the apparel to which the subassembly 2 is secured. The fabric materials of the apparel can be configured such that some amount of light emitted from the light panel 50 is transmitted through the apparel (e.g., in one or more selected patterns).

The strain relief mechanism 30 of the subassembly 2 absorbs at least some of the stress forces that may otherwise be applied to the wiring 32 to prevent disengagement of the conductive wires 39 with the conductive contact strips 52 thus preventing the occurrence of an unintentional electrical disengagement/open circuit between the power supply 60 and the light source 50. In particular, the radially and resiliently extending relief arms 38 of the strain relief connector 35 can absorb and disperse stretching or pulling forces applied to the apparel at the locations to which the subassembly 2 is attached to prevent, minimize or reduce strain and potential separation between the conductive wires 39 and conductive contact strips 52. The directional orientation of the strain relief arms 38 extending at different locations and in different directions from the central portion 36 provides strain relief for the wiring 32 due to stretching of the fabric material to which the strain relief mechanism 30 is coupled in multiple different directions of stretch. For example, the strain relief mechanism can be configured (such as depicted in FIG. 4) so that any one or more of the strain relief arms 38 can resiliently absorb stretching forces applied to the fabric and having force vectors that differ from each other throughout a 360° orientation in relation to the central portion 36 of the mechanism 30. This minimizes the impact of the stretching forces being applied to the wiring 32 which might otherwise cause a short or open circuit between electrical components connected via the wiring 32.

Figure 12C:
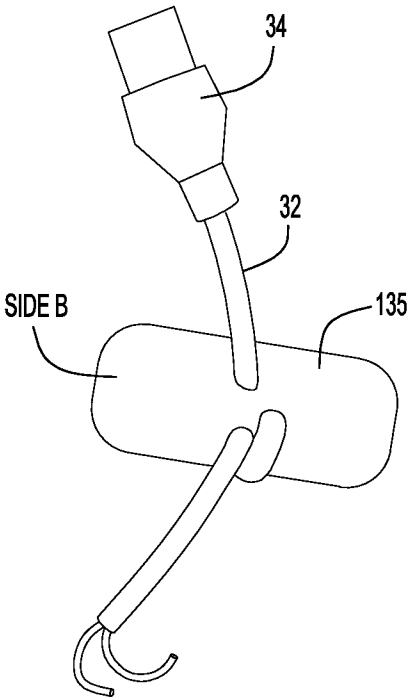
FIGS. 12A-12C are views of another example embodiment of a strain relief connector for use with the subassembly of FIG. 1.
Figure 12B:
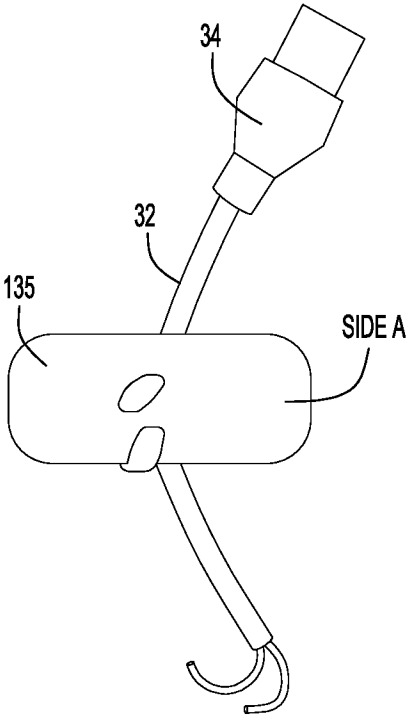
Figure 12A:
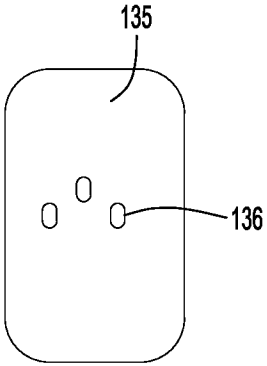

While the strain relief connector 35 described for the embodiment of FIGS. 1-4 has a general "X" shape or configuration, other strain relief connectors can also be provided for the subassembly 2 that provide similar strain relief to the wiring 32 (to prevent complete separation between conductive wires and conductive contact strips). For example, a strain relief connector of a different type that can provide the same function of preventing or minimizing strain applied to the wiring 32 of the strain relief mechanism 30 is depicted in FIGS. 12A-12C.

In particular, an alternative embodiment of a strain relief connector 135 comprises a thin and generally rectangular base plate comprising a suitably flexible polymer (e.g., polystyrene) or other material and including a plurality of openings 136 (three openings depicted in FIGS. 12A-12C) extending through the base plate to facilitate winding or wrapping of a portion of the wiring 32 through the openings and around portions of the base plate during construction of the subassembly for securing an engagement between the connector 34 and the light panel 50. The winding/wrapping engagement between the wiring 32 and the strain relief connector 135 is depicted in FIGS. 12B and 12C, where opposing sides (side A and side B) of the base plate show how the wiring 32 is guided through the openings 136. The strain relief connector 135 can be secured to the base plate 4 of the subassembly in a similar manner as described herein for strain relief connector 35. Other types of strain relief connectors can also be implemented in the subassembly to prevent, minimize or reduce strain applied to the wiring of the strain relief mechanism when the apparel or other textile item to which the subassembly is secured is being stretched, pulled, twisted or subjected to other types of stress forces that strain the apparel or textile item.

Figure 13:
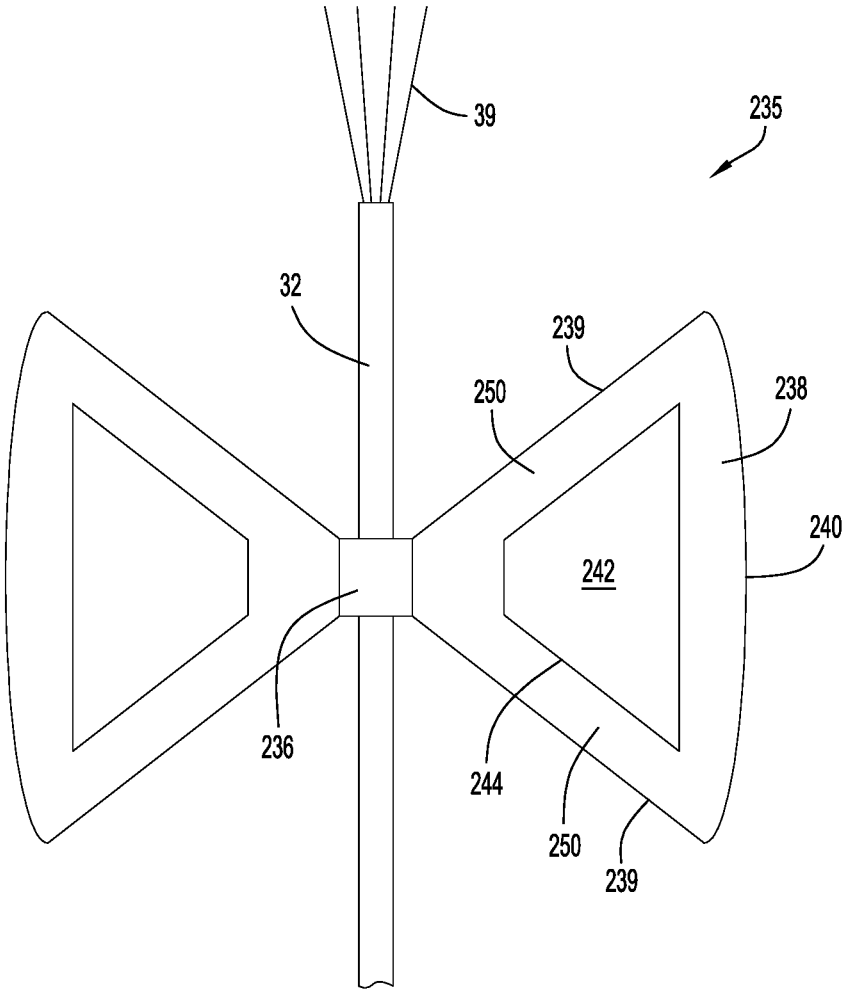
FIG. 13 is a further example embodiment of a strain relief connector for use with the subassembly of FIG. 1.

A further embodiment of a strain relief connector 235 is depicted in FIG. 13. Like the strain relief connector 35 depicted in FIG. 4, the strain relief connector 235 comprises a thin base plate including a plurality of relief arms 238 extending radially outward in different directions from a central portion 236. In particular, the connector 235 includes two relief arms 238 that extend at opposing sides or locations of the central portion 236 so as to be offset from each other by about 180°. Each relief arm 238 has a width that increases as the arm extends outward from the central portion 236, such that the opposing lengthwise edges 239 of each relief arm 238 are nonparallel and diverge outward and away from each other as the edges 239 extend away from the central portion 236. The terminal or free end 240 of each relief arm 238 has a generally curved and convex edge that joins with each of the lengthwise edges 239, such that the strain relief connector 235 has a general "bowtie" shape or configuration. The relief arms 238 can be the same or similar in size. Alternatively, the relief arms 238 can differ in size. The connector 235 can also be formed of any suitably resilient and durable material (e.g., flexible metals and/or flexible polymer materials) that facilitates resilient stretching or straining of relief arms 238 of the connector 235 in different directions based upon stretching forces applied to the top and/or bottom panels 4, 6 during use of the assembly 2.

In example embodiments, each relief arm has a portion of material removed, e.g., from a central or other interior location the relief arm body, so as to enhance the resilient stretch/strain function and operability of the relief arm. In the example embodiment of FIG. 13, a portion of material is removed from each relief arm 238 to define an opening or cut-out section 242 within the interior of the relief arm. The cut-out section 242 can have any suitable size and/or shape that enhance the flexing capability of the relief arm. For example, the cut-out section 242 can have a shape that is the same or similar to the shape of the relief arm, where the cut-out section 242 is defined by opposing and lengthwise extending cut edges 244 that diverge outward from each other and are generally parallel with corresponding lengthwise edges 239 of the arm 238. The cut-out section 242 results in smaller width arm portions 250 (i.e., arm portions extending in the lengthwise direction of the relief arm and having smaller widths than the overall width of the relief arm) that facilitate enhanced flexing of the relief arm 238 during stretch and strain forces applied to the fabric or textile material with which the strain relief mechanism is coupled.

The strain relief connector 235 can be implemented as the strain relief mechanism 30 of the subassembly 2, where conductive wiring is coupled with the central portion 236 of the connector 235 in a similar manner as described herein for connector 35. The strain relief connector 235 absorbs at least some of the stress forces that may otherwise be applied to the wiring 32 to prevent disengagement of the conductive wires 39 with the conductive contact strips 52 thus preventing the occurrence of an unintentional electrical disengagement/open circuit between electronic components in electrical communication with each other via the conductive wiring. The resiliently extending relief arms 238 of the strain relief connector 235 can absorb and disperse stretching or pulling forces applied to the apparel at the locations to which the subassembly 2 is attached to prevent, minimize or reduce strain and potential separation between the conductive wires 39 and conductive contact strips 52. In particular, the radially and resiliently extending relief arms 238 of the strain relief connector 235 can absorb and disperse stretching or pulling forces applied to the apparel at the locations to which the subassembly 2 is attached to prevent, minimize or reduce strain and potential separation between the conductive wires 39 and conductive contact strips 52. The directional orientation of the strain relief arms 238 extending at different locations and in different directions from the central portion 36 as well as the geometry of the arms (providing a "bowtie" like shape) provides strain relief for the wiring 32 due to stretching of the fabric material to which the strain relief mechanism 30 is coupled in multiple different directions of stretch. For example, the strain relief arms 238 can resiliently absorb stretching forces having force vectors that differ from each other throughout a 360° orientation in relation to the central portion 236, thus minimizing the impact of the stretching forces being applied to the wiring 32 which might otherwise cause a short or open circuit between electrical components connected via the wiring 32.

Thus, the electronic subassembly with strain relief mechanism provides a simple and effective structure to integrate one or more electronic components with an apparel or other textile product while preventing or minimizing strain to electrical connections within the subassembly when the apparel or textile product is pulled, stretched, twisted or subjected to other types of strains. For example, the subassembly can be easily integrated with apparel using heating techniques as described herein, where integration of the subassembly with apparel products can be performed by the apparel manufacturer (where the subassembly is provided by a vendor of the apparel manufacturer).

Any selected types of electronic components can be provided within the subassembly for integration with apparel or other textile products including, without limitation, lighting or illumination devices, computerized devices (e.g., processors, displays, touch pads, computer memories, etc.) for performing any number and types of different computer processing functions (e.g., recording and displaying exercise or other data of interest to the apparel user), etc.

In addition, in another alternative embodiment, the electronic subassembly can be integrated with apparel such that one panel of the subassembly comprises the apparel itself (e.g., a surface of a T-shirt or other clothing/apparel item serves as one panel of the subassembly).

Figure 14:
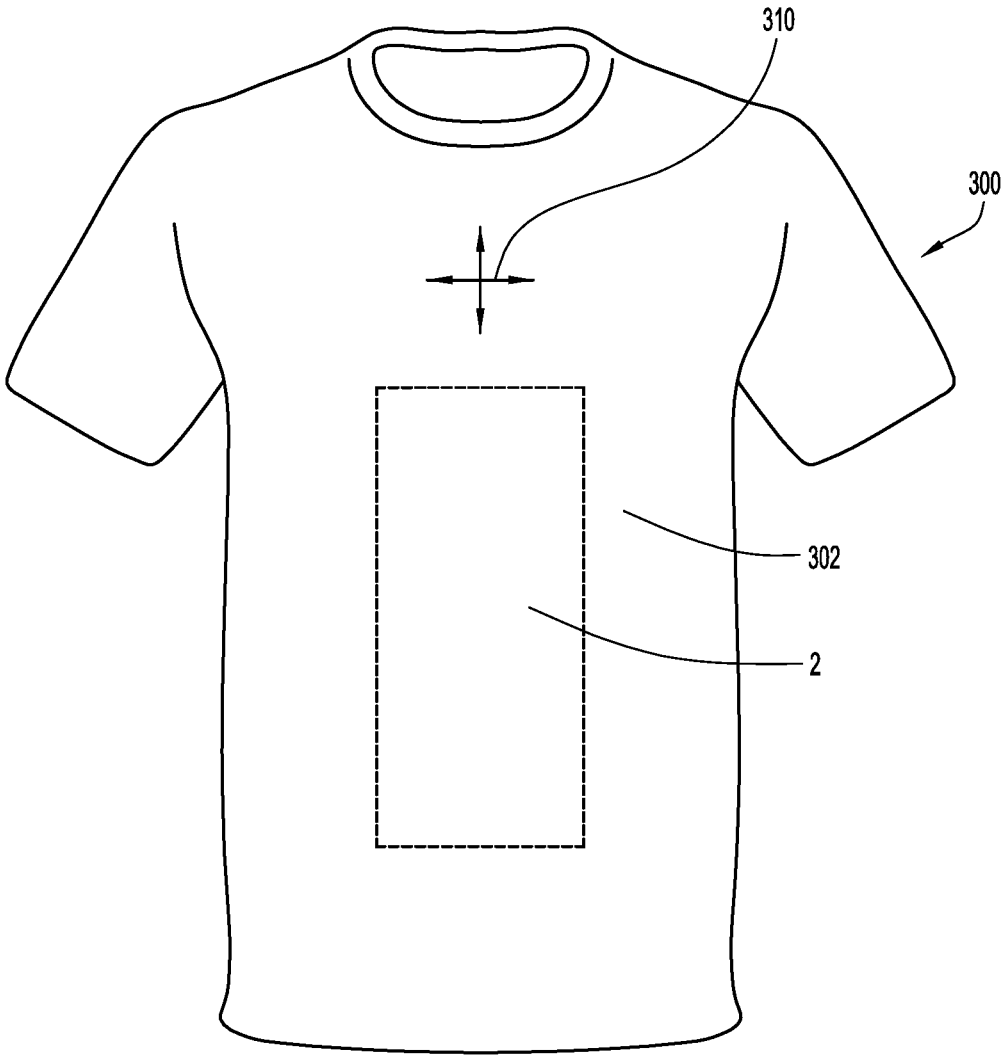
FIG. 14 is a view of an example embodiment of the electronic subassembly integrated with an apparel item.

An example embodiment is depicted in FIG. 14 of an apparel item that includes the electronic subassembly described herein incorporated with the apparel item. In particular, an apparel item in the form of a sports shirt 300 (e.g., T-shirt) includes the electronic subassembly 2 incorporated with the shirt, where the electronic subassembly is shown generally in dashed lines. The shirt 300 is configured to fit around the chest, torso and arms of a user and is formed of one or more layers of textile or fabric materials, such as any conventional and/or other types of textile materials. For example, the shirt can be formed of textile materials suitable for use in sports and/or exercise activities including, without limitation, cotton materials and/or synthetic fiber materials (e.g., nylon/polyamide, polyester/polyethylene terephthalate, polyurethane, polylactic, acrylic/acrylonitrile, polyolefins such as polyethylene and polypropylene and any combinations thereof) including stretch materials such as Spandex or Lycra (polyester/polyurethane copolymer fibers) The shirt includes an exterior surface 302 that faces away from the user's body and an interior surface facing the user's body when the shirt 300 is worn by the user. The top panel 6 of the subassembly 2 can be secured to the interior surface of the shirt 300, e.g., via an adhesive and/or in any other suitable manner. Alternatively, the top panel 6 can be integrated as part of one or more layers of the shirt 300 such that a surface the top panel 6 and exterior surface 302 of the shirt 300 are integrated as a single surface. In an example embodiment in which an electronic component of the subassembly 2 includes a light panel 50, the light panel 50 transmits light from the exterior surface 302 of the shirt 300 during use of the subassembly.

During use of the shirt 300, stretching of the shirt in different directions can occur (including directions generally indicated by arrows 310 in FIG. 14) particularly when the user is engaging in physical activities and/or when the shirt is pulled (e.g., someone grabs the user's shirt and pulls it in one or more different directions). The strain relief mechanism 30 absorbs straining forces that might be applied at the subassembly 2 due to stretching of the shirt 300, thus substantially limiting or preventing stretching or straining of the wiring that connects electronic components associated with the subassembly 2 (e.g., the wiring 32 that connects the light panel 50 with the electrical connector 40). This minimizes electrical shorting or disconnection between electronic components associated with the subassembly during use of the shirt 300, particularly when the user engages in physical activities.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. An electronic subassembly comprising:

a base panel comprising a layer of fabric material;

a top panel secured to the base panel so as to form a compartment between the base panel and the top panel, the top panel including an exterior surface that is configured to couple the subassembly with an apparel product;

a plurality of electronic components, wherein a first electronic component is disposed within the compartment and a second electronic component extends from the compartment to a location external to the compartment, the first electronic component includes a first electrical connection with a first end, the second electronic component includes a second electrical connection with a second end, and the first end of the first electrical connection engages so as to form an electrical contact with the second end of the second electrical connection at a location within the compartment; and a strain relief mechanism disposed within the compartment that maintains the electrical contact between the first electrical connection of the first electronic component and the second electrical connection of the second electronic component, wherein the strain relief mechanism is configured to reduce strain imparted to the first electrical connection and/or the second electrical connection when a surface of the apparel product to which the subassembly is secured is subjected to stretching forces.

2. The electronic subassembly of claim 1, wherein the strain relief mechanism comprises a central portion and a plurality of elongated arms extending outward and in different directions from the central portion.

3. The electronic subassembly of claim 2, wherein at least one arm has a width that varies along a length of the arm.

4. The electronic subassembly of claim 3, wherein the width increases as the arm extends outward from the central portion.

5. The electronic subassembly of claim 4, wherein the strain relief mechanism includes a first arm extending from a first part of the central portion and a second arm extending from a second part of the central portion that is offset from the first part by about 180°.

6. The electronic subassembly of claim 2, wherein at least one arm has a cut-out section defining an opening that extends through the arm.

7. The electronic subassembly of claim 6, wherein the strain relief mechanism includes a pair of arms separated from each other by about 180°.

8. The electronic subassembly of claim 7, wherein the width of each arm increases as each arm extends outward from the central portion.

9. The electronic subassembly of claim 2, wherein the strain relief mechanism includes four arms extending outward at different locations from the central portion such that the strain relief mechanism has an X shape.

10. The electronic subassembly of claim 1, further comprising wiring that electrically couples the first electronic component with the second electronic component, wherein the strain relief mechanism comprises a plate including at least one opening extending through the plate, and the wiring extends through the opening and wraps around a portion of the plate.

11. The electronic subassembly of claim 1, wherein the second electronic component couples a power supply source external to the compartment to the first electronic component disposed within the compartment.

12. An apparel product comprising the electronic subassembly of claim 1.

13. A method of forming an electronic subassembly coupled with a fabric material, the method comprising:

arranging a plurality of electronic components along a base panel, wherein the base panel comprises a fabric material, the electronic components comprise a first electronic component and a second electronic component, the first electronic component includes a first electrical connection with a first end, and the second electronic component includes a second electrical connection with a second end;

engaging the first end of the first electrical connection with the second end of the second electrical connection so as to form an electrical contact between the first and second ends;

coupling a strain relief mechanism with the second electrical connection to maintain the electrical contact between the first electrical connection of the first electronic component and the second electrical connection of the second electronic component; and securing a top panel to the base panel so as to form the electronic subassembly, the electronic subassembly comprising a compartment between the base panel and the top panel with the first component and strain relief mechanism being disposed within the compartment and the second electronic component extending from the compartment to a location external to the compartment, the top panel including an exterior surface that is configured to couple the subassembly with an apparel product;

wherein the strain relief mechanism is configured to reduce strain imparted to the first electrical connection and/or the second electrical connection when a surface of the apparel product to which the subassembly is secured is subjected to stretching forces.

14. The method of claim 13, further comprising:

securing the electronic subassembly, via the exterior surface of the top panel, to a surface of the apparel product.

15. The method of claim 13, wherein the exterior surface of the top panel comprises a portion of the apparel product.

16. The method of claim 13, wherein the first electronic component comprises a light pane and the top panel includes a window to facilitate emission of light by the light panel from the subassembly.

17. The method of claim 13, wherein the second electronic component couples a power supply source external to the compartment to the first electronic component disposed within the compartment.

* * * * *